US010443144B2

(12) United States Patent
Dyke et al.

(10) Patent No.: US 10,443,144 B2
(45) Date of Patent: Oct. 15, 2019

(54) METHOD FOR ELECTRODEPOSITION ON A CONDUCTIVE PARTICULATE SUBSTRATE

(71) Applicant: BAE SYSTEMS PLC, London (GB)

(72) Inventors: Amy Elizabeth Dyke, South Gloucestershire (GB); Michael Dunleavy, South Gloucestershire (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 15/502,573

(22) PCT Filed: Feb. 18, 2015

(86) PCT No.: PCT/GB2015/050456
§ 371 (c)(1),
(2) Date: Feb. 8, 2017

(87) PCT Pub. No.: WO2016/024078
PCT Pub. Date: Feb. 18, 2016

(65) Prior Publication Data

US 2017/0241034 A1 Aug. 24, 2017

(30) Foreign Application Priority Data

Aug. 14, 2014 (GB) ..... 1414431.5

(51) Int. Cl.
*C25D 7/00* (2006.01)
*C25D 17/00* (2006.01)
(Continued)

(52) U.S. Cl.
CPC ..... *C25D 7/006* (2013.01); *C25D 3/20* (2013.01); *C25D 5/006* (2013.01); *C25D 17/002* (2013.01); *C25D 21/10* (2013.01)

(58) Field of Classification Search
CPC ..... C25D 7/006; C25D 5/006; C25D 17/002; C25D 3/20
See application file for complete search history.

(56) References Cited

U.S. PATENT DOCUMENTS 3,607,675 A * 9/1971 Haines ..... C25C 5/02 205/50
3,974,049 A * 8/1976 James ..... C02F 1/46114 205/348
(Continued)

FOREIGN PATENT DOCUMENTS

EP 1978582 A 10/2008
JP S63162897 A 7/1988
(Continued)

OTHER PUBLICATIONS

International Preliminary Report on Patentability of International Application No. PCT/GB2015/050456, dated Feb. 23, 2017, 7 pages.
(Continued)

*Primary Examiner* — Louis J Rufo
(74) *Attorney, Agent, or Firm* — Maine Cernota & Rardin

(57) ABSTRACT

The present invention relates to a method of electrodepositing a metal on an electrically conductive particulate substrate. There is provided a method of electrodepositing a metal on an electrically conductive particulate substrate comprising the steps of: (i) providing a cathode; (ii) providing an anode formed from the metal to be electrodeposited; (iii) providing the substrate, cathode and anode within an electrodeposition bath comprising an electrolyte; and (iv) providing a voltage between said anode and cathode causing metal ions to flow from the anode to the cathode, wherein a separator is provided between the anode and the cathode.

10 Claims, 6 Drawing Sheets

(51) Int. Cl.

| | |
|---|---|
| ***C25D 21/10*** | (2006.01) |
| ***C25D 3/20*** | (2006.01) |
| ***C25D 5/00*** | (2006.01) |

(56) References Cited

U.S. PATENT DOCUMENTS

| | | | | |
|---|---|---|---|---|
| 4,443,305 | A | 4/1984 | Haynes | |
| 4,465,264 | A * | 8/1984 | Lin | B22F 9/16 204/242 |
| 4,908,106 | A * | 3/1990 | Takeshima | C25D 5/08 205/148 |
| 6,010,610 | A * | 1/2000 | Yih | C25D 7/006 205/149 |
| 6,482,298 | B1 | 11/2002 | Bhatnagar | |
| 2006/0060520 | A1 | 3/2006 | Bomberger et al. | |
| 2006/0159949 | A1* | 7/2006 | Yoo | C25D 1/04 428/680 |
| 2012/0245017 | A1* | 9/2012 | Adzic | C25D 5/20 502/1 |

FOREIGN PATENT DOCUMENTS

| | | | | |
|---|---|---|---|---|
| JP | H06108299 | A | | 4/1994 |
| JP | H06108299 | A | * | 4/1999 |
| JP | 2002069689 | A | | 3/2002 |
| WO | 2012118434 | A1 | | 9/2012 |

OTHER PUBLICATIONS

Great Britain Search Report of Application No. GB14144315, dated Mar. 8, 2015, 5 pages.

Templated electrosynthesis of nanomaterial and porous structures, Lai M et al, Journal of Colloid and Interface Science, 323, (2008) pp. 203-212 note section 4.2.

"Electroplating" Jul. 1, 2009, HowStuffWorks.com, http://science.howstuffworks.com/electroplating-info.htm, Accessed on Mar. 18, 2015.

* cited by examiner

METHOD FOR ELECTRODEPOSITION ON A CONDUCTIVE PARTICULATE SUBSTRATE

RELATED APPLICATIONS

This application is a national phase application filed under 35 USC § 371 of PCT Application No. PCT/GB2015/050456 with an International filing date of Feb. 18, 2015 which claims priority of GB Patent Application 1414431.5 filed Aug. 14, 2014. Both of these applications are herein incorporated by reference in its entirety for all purposes.

FIELD OF THE INVENTION

The present invention relates to a method of electrodepositing a metal on an electrically conductive particulate substrate.

BACKGROUND OF THE INVENTION

Galvanic electrodeposition is a well-known methodology primarily used for the deposition of high quality metallic films with controllable thickness, forming objects by electroforming and altering the surface properties of an object such as; abrasion and wear resistance, corrosion protection, lubricity, magnetic resistance and conductivity and aesthetic qualities amongst others. Electrodeposition is generally understood to mean the precipitation of a metal at an electrode as the result of applying an electric field or current through an electrolyte.

SUMMARY OF THE INVENTION

Before the present invention is described in further detail, it is to be understood that the invention is not limited to the particular embodiments described, and as such may, of course, vary. It is also to be understood that the terminology used herein is for the purpose of describing particular embodiments only, and is not intended to be limiting, since the scope of the present invention will be limited only by the appended claims.

According to a first aspect of the invention, there is provided a method of electrodepositing a metal on an electrically conductive particulate substrate comprising the steps of:

(i) providing a cathode;

(ii) providing an anode formed from the metal to be electrodeposited;

(iii) providing the particulate substrate, cathode and anode within an electrodeposition bath comprising an electrolyte; and (iv) providing a voltage between said anode and cathode causing metal ions to flow from the anode to the cathode.

In order to achieve current flow the electrodes themselves need to be electrically conductive thus the item to be plated also needs to be electrically conductive. It is found that in order to coat particulate substrates an electrical connection has to be made. The problem however, is that in order to establish such an electrical connection:

(i) the particulate substrates should be electrically conductive (i.e. can conduct electrons); and (ii) a method is required that confines the electrically conductive particulate substrate proximate to the cathode thereby increasing the concentration of the particulate substrate at the cathode, to reduce the dispersion of the particulates into a larger volume of the surrounding electrolyte.

The substrate is an electrically conductive particulate substrate, and which is capable of being dispersed. The substrate may be selected from an electrically conductive material or a non-conductive material with a conductive layer deposed thereon. A non-conductive material may have a conductive layer deposed thereon by way of such as, for example, electroless plating of a thin coating of a conductor, such as, for example, silver.

The particulate substrate may be substantially spherical, elongate or have a high aspect ratio. Substantially spherical substrates may have a diameter in the range of 1 nanometer (nm) to 10 millimeters (mm). Preferably said substantially spherical substrates will have a diameter in the range of 1 nanometer (nm) to 100 micrometers (μm). Elongate substrates may have a diameter in the range of 1 nanometer (nm) to 10 millimeters (mm) and an average longest dimension i.e. length in the range of 1 to 100 μm. Preferably said elongate substrates will have a diameter in the range of 1 nanometer (nm) to 100 micrometers (μm) and a length in the range of 1 to 20 μm. Substrates with a high aspect ratio may have a diameter in the range of 1 to 100 nm and a length in the range of 1 to 100 μm. Preferably said substrates with high aspect ratios will have a diameter in the range of 50 to 100 nm and a length in the range 50 to 100.

The particulate substrate may have an average longest dimension of less than 10 mm, preferably less than 1 mm, wherein the substrate may not be physically connected to the cathode.

The substrate may be a particulate, powder, crystalline solid, amorphous solid, flake, whisker, chopped fibre, nano-/microsphere, cenosphere or nano-/microrod.

The substrate may be selected from any electrically conductive particulate substrate, non-conductive material with a conductive layer deposited thereon, metal alloy, semi-conductor, polymer, ceramic or glass material.

Said particulate may be selected from a nano-scaled carbon particulate such as, but not limited to for example fullerenes, graphite, graphene flakes, activated carbon fibres, carbon fabric and carbon nanoparticles. By virtue of the fact, miniaturisation to the nano-scale allows for enhanced intrinsic electrical properties, improving the electrical conductivity of the substrate.

Said flake formed of any substantially two-dimensional material may be selected from boron nitride, molybdenum sulphide or any homogeneous/heterogeneous multi-layered structure.

Said non-conductive material with a conductive layer deposited thereon may be a metal coated glass fibre, such as for example, silver coated glass fibre.

Said polymer may be selected from, but not limited to, polymer chopped fibres, whiskers or nano-/microspheres.

Said ceramic may be selected from, but not limited to, ceramic chopped fibres, whiskers, cenospheres or nano-/microrods.

Said glass material may be selected from, but not limited to, chopped fibres, whiskers or cenospheres.

In a preferred arrangement, the substrate may be, for example carbon nanotubes, such as for example multi-walled nanotubes (comprising concentrically cylindrical graphite sheets) or single walled nanotubes (comprising a one-atom-thick layer of graphite wrapped into a seamless cylinder), the carbon nanotubes may have a diameter in the range of from 1 to 400 nm and a length from 0.01 micron to 10 mm, preferably 1 to 5 microns.

The anode is formed from at least one suitable metal which will be the metal to be electrodeposited on said particulate. Any metal that can be deposited by electrodeposition may be used. There may be at least two separate suitable metals, so as to electrodeposit at least two different metals. The at least two separate suitable metals may be co-deposited or deposited sequentially to provide discrete layers. Subsequent co-deposition or deposition may provide an increase in layer thickness. The selected metal to be electrodeposed allows the metal coated particulate substrate to exhibit certain physical or chemical properties inherent to the chosen metal. Preferably said metal is one belonging to the transition metal series. Typically preferred examples of transition series metals selected as the metal coating are Pd, Pt, Cu, Ag, Au, Zn, Fe, Ni and Co. The metal may preferably be a ferromagnetic metal, such as Fe, Co or Ni or alloy thereof. This allows the metal coated substrate to exhibit enhanced magnetic properties such as high magnetic susceptibility. Preferably the metal is iron.

Formation of metal ions $M^{x+}$ (where x is an integer commensurate with the oxidation state of the metal ion) may be achieved during the electrodepositing process, prior to deposition of the metal occurring on the particulate substrate.

The cathode is formed from any electrically conductive material; typically any material commonly used in electrodeposition may be used such as, for example a conductive wire or mesh electrode.

The electrolyte may be any electrolyte commonly used in electrodeposition. The term "electrolyte" herein used to mean a solution or suspension of one or more dissolved metal salts as well as other ions. The electrolyte may be common to both the anode and cathode.

A power source is provided such as to set up an electrical voltage between the cathode and anode, so as to cause an electric current to flow between the cathode and anode.

In a further preferred arrangement, a separator may be introduced between the anode and cathode. The separator may be any means of increasing the concentration of the particulate substrate proximate to the cathode whilst still allowing the metal ions from the anode to migrate towards the particulate substrate. This is particularly advantageous as the separator acts as a barrier confining the particulate substrate and reducing its dispersion into a larger volume of electrolyte, whilst still allowing electrodeposition to occur.

Confinement of the particulate substrate proximate to the cathode increases the deposition rate of the metal onto the substrate. Without being bound to theory, the application of an external electric field not only aligns the particulate substrate but may also enhance the attractive forces between neighbouring particulate substrates. Above a certain concentration, their "concentration" known herein as the percolation threshold, which can be as little as a few percent volume, there may be formed a particulate substrate network exhibiting long-range connectivity. The percolation threshold may be in the range of 0.001 to 5 vol %. Preferably the percolation threshold will be in the range of 0.01 to 1 vol %. Containment of the particulate substrate proximate to the cathode aligns the particulate substrate relative to the cathode and thus the said long-range particulate substrate network serves as an extension to the cathode. This directs the migration of positively charged metal ions from the anode to the negatively charged substrate thus coating the substrate in the metal.

The separator may be a semipermeable membrane, which is porous to the electrolyte and metal ions, but with a pore size sufficiently small enough to retain i.e. confine the particulate substrate proximate to the cathode. Preferably, the semipermeable membrane substantially envelopes both the substrate and the cathode and as such reduces particulate substrate dispersion into a larger volume of electrolyte. The provision of serpentine or labyrinthine pathways in the semipermeable membrane may be advantageous as this will create a tortuous path through which retention of the particulate substrate may be improved, whilst allowing the electrolyte comprising the metals ions, to pass freely therethrough. The provision of said pathways may also enable a larger range of suitably sized pores in the semipermeable membrane to be selected.

The separator may be an organic liquid phase that is immiscible with the aqueous liquid phase, which comprises the electrolyte, to form a biphasic system comprising two immiscible liquids. The term "biphasic system" herein used to mean any arrangement that utilises two immiscible liquid systems, commonly referred to as phases, thus creating a liquid interface. Preferably, the organic liquid phase comprises the particulate substrate to be coated. The relation of both organic and aqueous liquid phases may be as follows:

(i) a biphasic system contained within an electrodeposition bath in which the organic liquid phase is layered on top of the aqueous liquid phase; or (ii) a biphasic system contained within an electrodeposition bath in which the aqueous liquid phase is layered on top of the organic liquid phase.

Where the substrate is being electroplated in a biphasic system it is dispersed in an organic solvent in which the substrate is capable of being solvated in such as, for example a hydrocarbon, ketone, ester or ether solvent. Preferably the solvent is butyl acetate.

In a preferred arrangement the biphasic system will be such that the organic liquid phase is layered on top of the aqueous liquid phase. Such an arrangement is beneficial in that this limits the use of halogenated solvents. The aqueous liquid phase may be layered on top of the organic liquid phase where a denser organic solvent is used such as, for example a halogenated solvent. In a biphasic system the cathode is located in the organic liquid phase and does not transcend the liquid interface into the aqueous liquid phase to confine the particulate substrate proximate to the cathode. The anode is located only in the aqueous liquid phase. In such an arrangement, electrodeposition occurs substantially at the liquid interface i.e. where the particulate substrate and metal ions meet. Electrodeposition may also occur where the aqueous liquid phase, which comprises the electrolyte, diffuses into the organic liquid phase i.e. as an emulsion. Preferably, the volume of the organic liquid phase will be less than the volume of the aqueous liquid phase to act so as to increase the concentration of the particulate substrate.

In a further arrangement an agitation device may be introduced to reduce particle agglomeration. This allows a dynamic environment to be maintained within the electrodeposition bath, promoting dispersion of the substrate. The agitation device may be any known device such as, for example, the introduction of a stirrer, such as an overhead stirrer or magnetic stirrer, a purging gas, such as $N_2$ or a noble gas, or a sonicating source, such as ultrasound. The application of ultrasound may be at a frequency of 15-20 kHz and applied at <80 W. This allows the substrate to remain dispersed while ensuring any damage to the substrate is minimised.

Where the use of the separator is by way of a biphasic system, the introduction of a non-ionic surfactant into the organic liquid phase may reduce particle agglomeration.

In a preferred arrangement, at least two separate agitation devices are used.

Where the metal coating is a ferromagnetic metal, the application of a magnetic field may be used to capture any ferromagnetic metal coated substrate from the electrodeposition bath. A typical example of a magnetic field may be a permanent magnet or electromagnet.

The captured substrate is an electrically conductive particulate comprising an electrodeposited metal thereon, of which, the method may comprise the use of apparatus commonly used in a batch or continuous process.

According to a second aspect of the current invention, there is provided a conductive particulate substrate material with an average largest dimension of less than 10 mm comprising at least one layer of an electrodeposited metal thereon.

According to a further aspect of the current invention there is provided a conductive particulate substrate material comprising at least one layer of an electrodeposited metal thereon, manufactured by any one of the methods of the present invention as disclosed herein.

EXPERIMENTAL

The electrolyte used is common to both the semi-permeable membrane system and the biphasic system and comprises the following:

(i) Deionised water (100 ml)

(ii) Iron chloride tetrahydrate, $FeCl_2.4H_2O$ (17.1 g)

(iii) Iron sulphate heptahydrate, $FeSO_4.7H_2O$ (24.0 g)

(iv) Sodium citrate, $Na_3C_6H_5O_7$ (15.0 g)

The following method was used in the semi-permeable membrane system.

Electrically conductive particles (silver plated glass fibres) were dispersed in 10 ml of electrolyte, housed within a semi-permeable membrane. The semi-permeable membrane also contained a nickel mesh cathode connected to an external circuit. The sealed semi-permeable membrane containing the electrically conductive dispersion was then immersed in a larger electrodeposition bath of electrolyte containing an iron anode. Current density was set to −50 mA/cm$^2$. Typical deposition times were between 30-60 minutes. Following iron deposition, the semi-permeable membrane was removed and the contents transferred to a glass beaker where the collected material was then dispersed with water to remove any adhered electrolyte. A magnet was placed on the outside of the beaker to attract any iron coated particles and the water was then decanted. This process was repeated three times before the collected material was washed with acetone and dried under a flow of nitrogen gas.

The following method was used in the biphasic system. 0.5 g of multiwall carbon nanotubes were dispersed in 70 ml of butyl acetate using an ultrasonic probe. This was added to 100 ml of electrolyte housed within an electrodeposition bath containing an iron anode such that the disturbance of the newly formed liquid interface was minimised (an organic phase comprising the nanotube dispersion in butyl acetate sitting on top of the aqueous phase containing the electrolyte). A nickel mesh cathode was placed parallel to the interface but within nanotube dispersion in butyl acetate. Current density was set to ~50 mA/cm$^2$. Upon formation of iron coated nanotubes a plastic coated magnet was placed in the near the liquid interface and after ~30 minutes, any coated nanotubes removed from the system before being washed into a glass beaker with water. The iron coated nanotubes were then dispersed in water to remove any adhered electrolyte. The magnet was placed on the outside of the beaker to attract any iron coated nanotubes and the water was then decanted. This process was repeated three times before the collected nanotubes were washed with acetone and dried under a flow of nitrogen gas.

BRIEF DESCRIPTION OF THE DRAWINGS

Exemplary embodiments are illustrated in referenced figures of the drawings and are part of the specification. It is intended that the embodiments and figures disclosed herein are to be considered illustrative of the present invention and do not limit the scope thereof.

DETAILED DESCRIPTION

Figure 1:
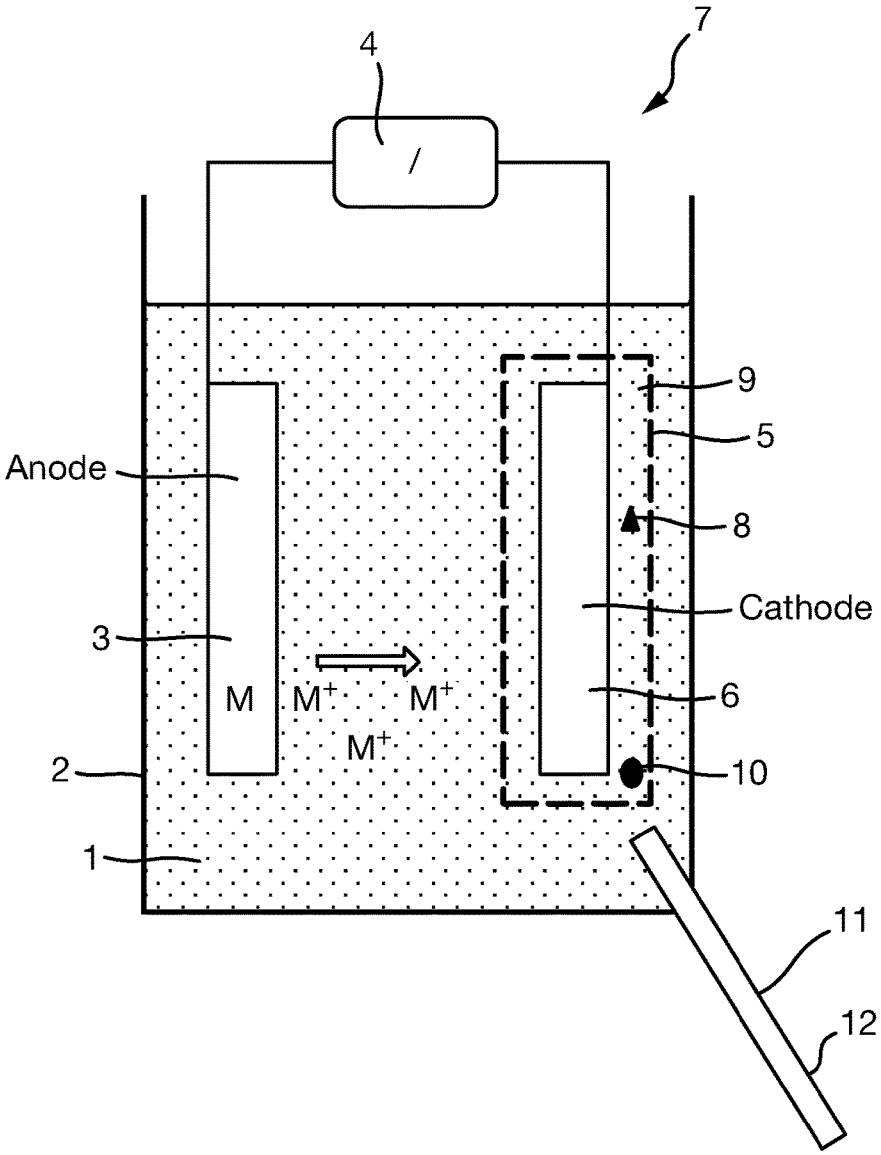
FIG. 1 illustrates a schematic of a batch electrodeposition process according to one exemplary embodiment.

Turning to FIG. 1, there is provided a batch electrodeposition system 7. The anode 3 which is formed from the metal to be electrodeposited, and cathode 6 are both connected to a power source 4. The electrical circuit is completed by immersing both anode 3 and cathode 6 in an electrolyte 1 housed within an electrodeposition bath 2. The electrolyte 1 allows the free movement of metal ions $M^+$ generated from the anode 3, which migrate to the cathode 6. A separator 9 in the form of a semipermeable membrane 5 substantially envelopes the cathode 6 and the electrically conductive particulate substrate 8. The semipermeable membrane 5 is porous to the electrolyte 1 and metal ions M+, but with a pore size sufficiently small enough to confine the particulate substrate 8 proximate to the cathode 6. The semipermeable membrane 5 reduces dispersion of the particulate substrate 8 into the larger volume of electrolyte 1. Activating the power source 4 sets up a voltage between the anode 3 and cathode 6. The application of an external electric field not only aligns the particulate substrate 8 but also enhances the attractive forces between neighbouring particulate substrate 8 particulates. Above the percolation threshold, there is formed a particulate network exhibiting long-range connectivity. Containment of the substrate 8 proximate to the cathode 6 aligns the particulates relative to the cathode 6 and thus the said long-range particulate network serves as an extension to the cathode 6. This directs the migration of metal ions $M^+$ from the anode 3 to the negatively charged particulate substrate 8 thus coating the particulate substrate 8 and resulting in the desired metal coated substrate 10. To ensure the particulate substrate 8 remains dispersed, an agitation device 11 may be introduced into the batch electrodeposition system 7. The agitation device used may be an ultrasound probe 12.

Figure 2:
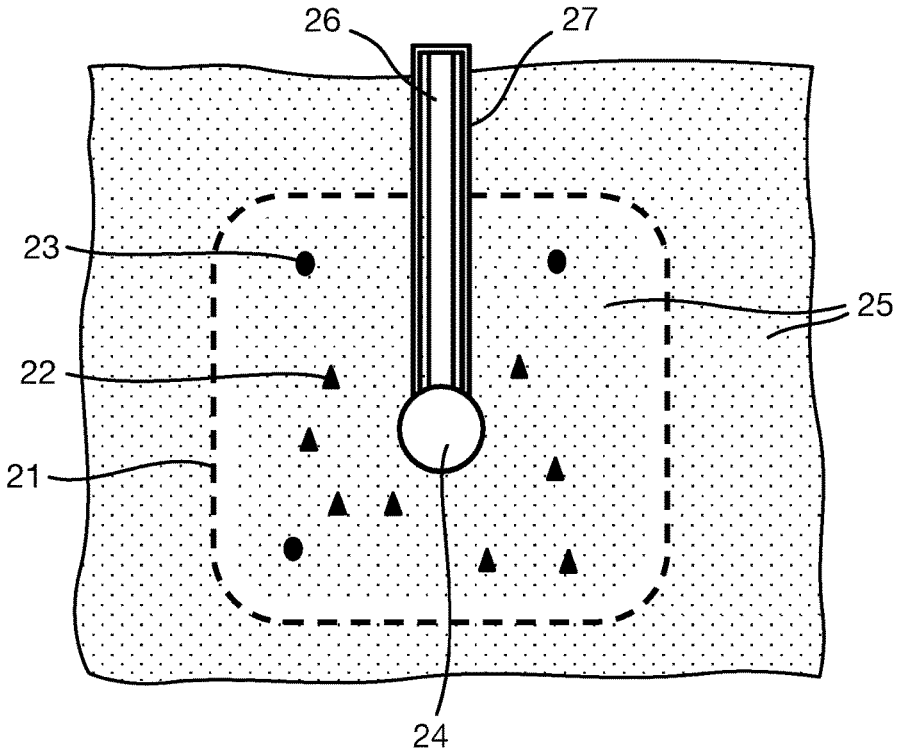
FIG. 2 illustrates a schematic of the semipermeable membrane electrode according to one exemplary embodiment.

FIG. 2 provides an expanded view of the cathode 26 as shown in FIG. 1. The semipermeable membrane 21 substantially envelopes the cathode 26 and the electrically conductive particulate substrate 22. The semipermeable membrane 21 is porous to the electrolyte 25 with a pore size sufficiently small enough to confine the particulate substrate 22 proximate to the cathode 26, reducing dispersion of the particulate substrate 22 into a larger volume of electrolyte 25. Electrical connection to the power source is by an insulated wire 27. The exposed section 24 of cathode 26 imparts a negative charge on the particulate substrate 22 thus serving as a cathode. This directs the migration of metal ions $M^+$ from the anode to the negatively charged particulate substrate 22 thus coating the particulate substrate 22 and resulting in the desired metal coated substrate 23.

Figure 3:
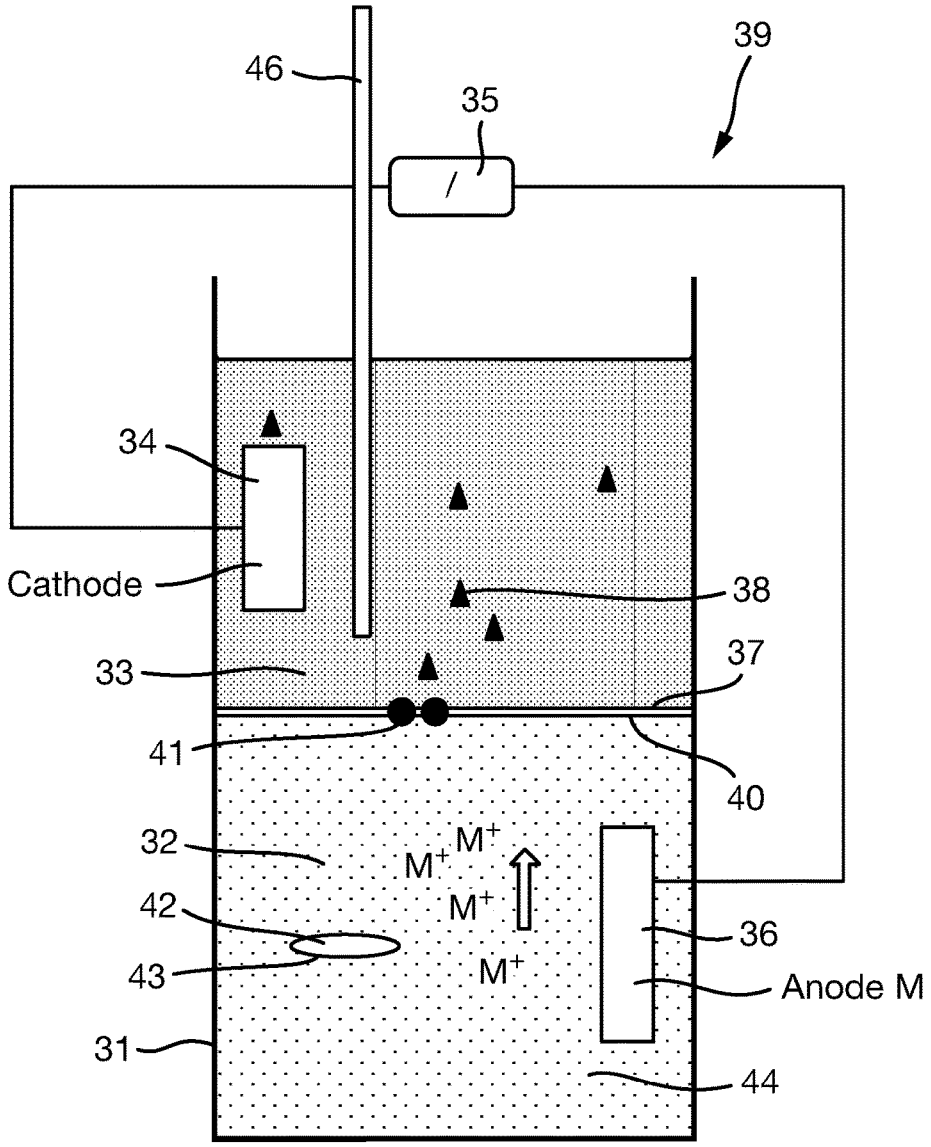
FIG. 3 illustrates a schematic of a batch biphasic system according to one exemplary embodiment.

FIG. 3 shows a batch biphasic system 39. The biphasic system 39 comprises an organic liquid phase 33 and an aqueous liquid phase 32 thus creating a liquid interface 37 which acts as a separator 40, thereby retaining the substrate 38 and reducing its dispersion into a large volume of electrolyte 44. The organic liquid phase 33 comprises the substrate 38 and an organic solvent, and the aqueous liquid phase 32 comprises the electrolyte 44. The cathode 34 is located in the organic liquid phase 33 and does not transcend the liquid interface 37. The cathode 34 and anode 36 are connected to the power source 35. The anode 36 is formed from the metal to be electrodeposited. is The electrical circuit is completed by immersing the cathode 34 in the organic liquid phase 33 and the anode 36 in aqueous liquid phase 32, both of which are housed within the electrodeposition bath 31. Activating the power source 35 sets up a voltage between the anode 36 and cathode 34. The application of an external electric field not only aligns the particulate substrate 38 but also enhances the attractive forces between neighbouring particulate substrates 38. Above the percolation threshold, there is formed a particulate network exhibiting long-range connectivity. Containment of the substrate 38 proximate to the cathode 34 aligns the particulates relative to the cathode 34 and thus the said long-range particulate network serves as an extension to the cathode 34. This directs the migration of metal ions $M^+$ from the anode 36 to the negatively charged particulate substrate 38. This allows coating of the particulate substrate 38 to occur substantially at the liquid interface 37 resulting in the desired metal coated substrate 41. To ensure a dynamic interface 37 and that the substrate 38 remains dispersed, an agitation device 42 may be introduced into the biphasic system 39. The agitation device used may be a magnetic stirrer 43.

A magnet 46 may also be periodically introduced to collect the magnetic metal coated substrate 41 in the organic liquid phase 33. The magnet 46 is placed away from the liquid interface 37 and removal of any magnetic metal coated substrate 41 ensures further coating occurs and prevents agglomeration by bridging between particles.

Figure 4:
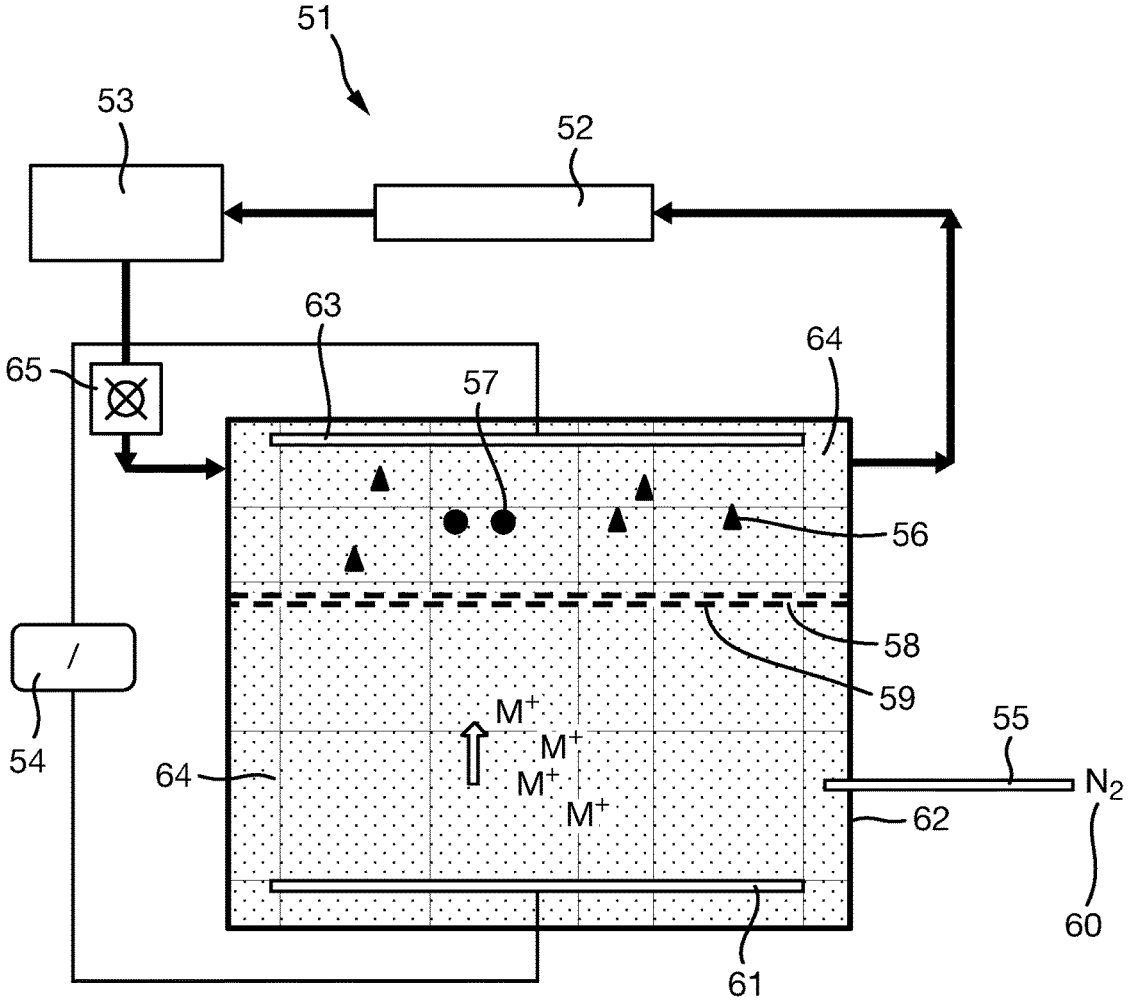
FIG. 4 illustrates a schematic of a continuous electrodeposition process according to one exemplary embodiment.

FIG. 4 shows a continuous electrodeposition system 51 housed within an electrodeposition bath 62. The anode 61, formed from the metal to be electrodeposited, is located in the electrolyte 64. The electrolyte 64 allows the free movement of metal ions $M^+$ from the anode 61 to cathode 63. The cathode 63 and anode 61 are connected to the power source 54. The semipermeable membrane 58 acts as a separator 59 reducing dispersion of the particulate substrate 56 into the larger volume of electrolyte 64, below the semipermeable membrane 58. The semipermeable membrane 58 is porous to the electrolyte 64 with a pore size sufficiently small enough to confine the particulate substrate 56 proximate to the cathode 63. Activating the power source 54 sets up a voltage between the anode 61 and cathode 63. The application of an external electric field not only aligns the particulate substrate 56 but also enhances the attractive forces between neighbouring particulate substrates 56. Above the percolation threshold, there is formed a particulate network exhibiting long-range connectivity. Containment of the particulate substrate 56 proximate to the cathode 63 aligns the particulate substrate 56 relative to the cathode 63 and thus the said long-range particulate network serves as an extension to the cathode 63. This directs the migration of metal ions $M^+$ from the anode 61 to the negatively charged particulate substrate 56 thus coating the substrate 56 and resulting in the desired metal coated substrate 57. To ensure the substrate 56 remains dispersed an agitation device 55 may be introduced into the continuous electrodeposition system 51. The agitation device used may be the introduction of a purging gas such as gaseous $N_2$ 60. The particulate substrate 56 is pumped by a pump system 65 from the reservoir of dispersion 53 into the continuous electrodeposition system 51. Periodically or continuously the volume above the membrane 58 of electrolyte 64, particulate substrate 56, electrolytic ions and metal coated substrate 57 is pumped out of the electrodeposition bath 62 and passed via a magnetic collector 52. Any magnetic metal coated substrate 57 is extracted by the magnetic collector 52 and any uncoated particulate substrate 56 is re-introduced through the reservoir of dispersion 53 and pumped back into the electrodeposition bath 62. A thicker coating of magnetic material may be achieved by re-dispersing any collected magnetic metal coated substrate 57 into the electrodeposition bath 62 and repeating the aforementioned process.

Figure 5:
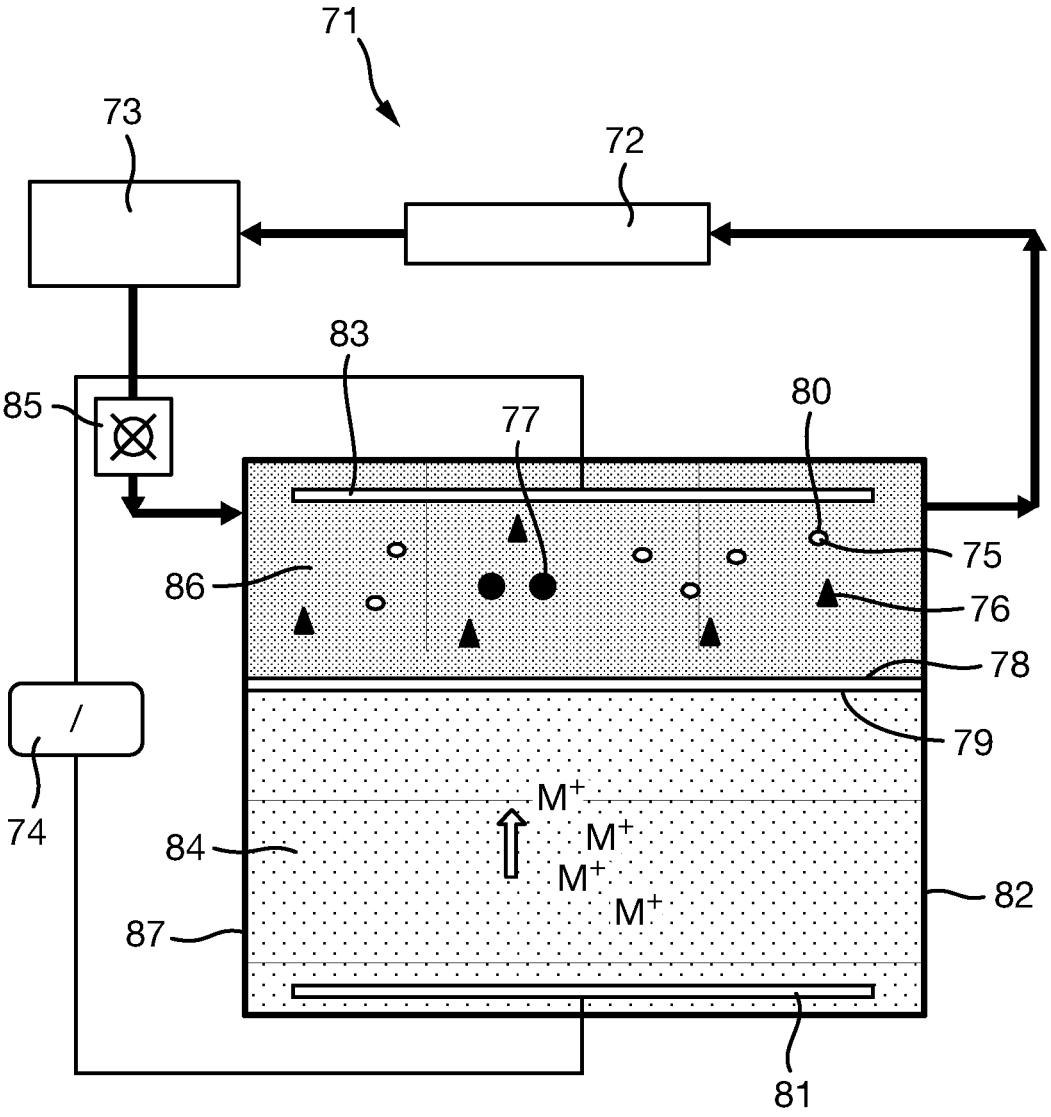
FIG. 5 illustrates a schematic of a continuous biphasic system according to one exemplary embodiment.
Figure 6:
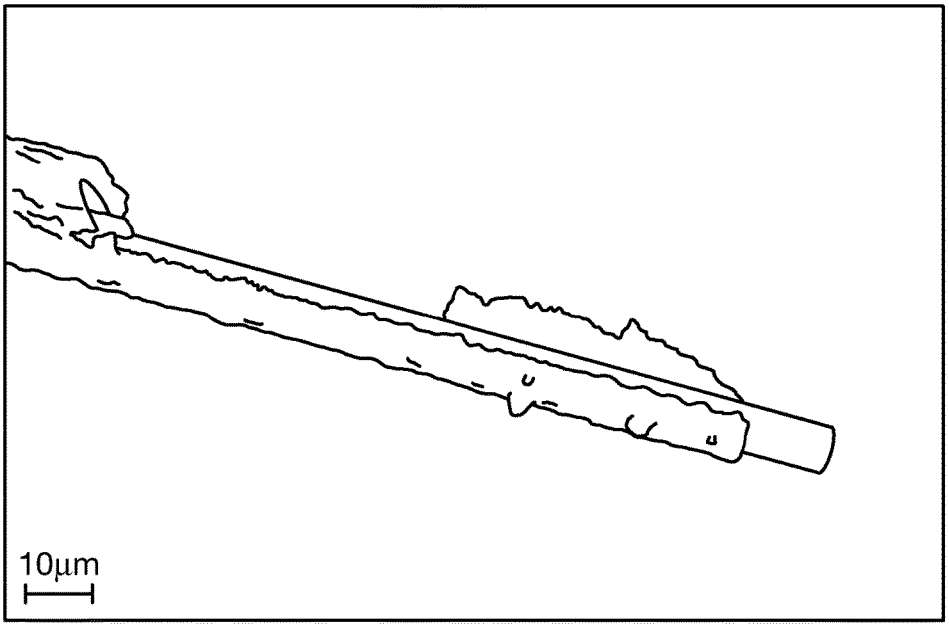
FIG. 6 illustrates an SEM image of iron deposited on silver plated glass micro fibres.
Figure 7:
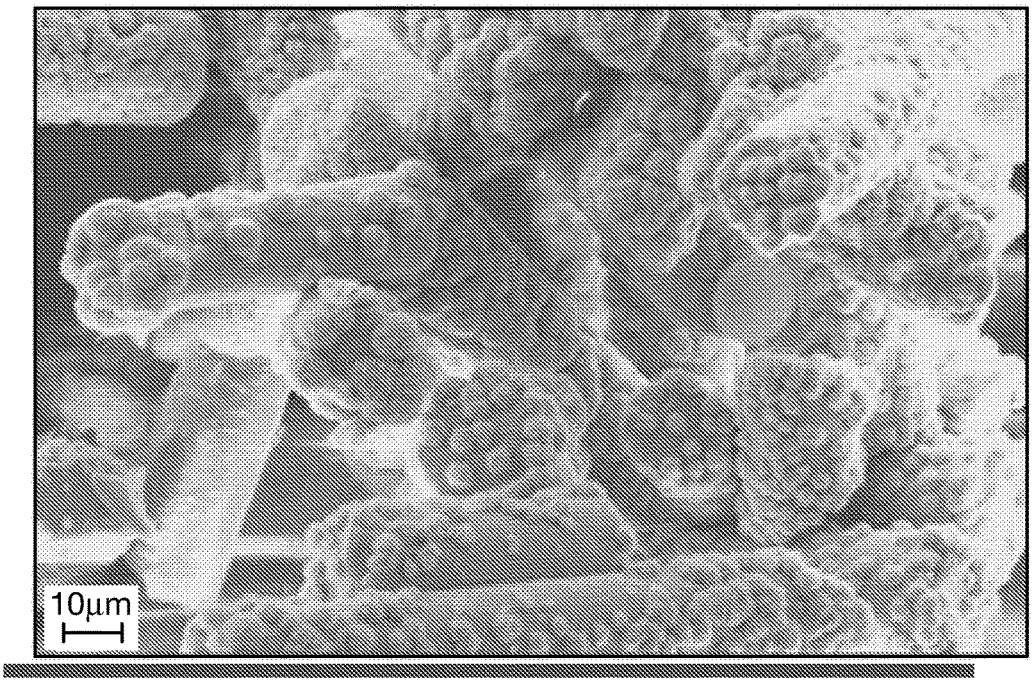
FIG. 7 illustrates an SEM image of iron deposited on carbon fibre.

FIG. 5 shows a biphasic continuous electrodeposition system 71 housed within an electrodeposition bath 82. The biphasic system 71 comprises an organic liquid phase 86 and an aqueous liquid phase 84 thus creating a liquid interface 78 which acts as a separator 79, thereby confining the particulate substrate 76 to the organic liquid phase 86 and reducing its dispersion into the larger volume of electrolyte 84. The organic liquid phase 86 comprises the particulate substrate 76 and organic solvents. The aqueous liquid phase 87 comprises the electrolyte 84. The cathode 83 is located only in the organic liquid phase 86 and does not transcend the liquid interface 78. The cathode 83 and anode 81 are connected to the power source 74. The anode 81 is formed from the metal to be electrodeposited and is located only in the aqueous liquid phase 87. Activating the power source 74 sets up a voltage between the anode 81 and cathode 83. The application of an external electric field not only aligns the particulate substrate 76 but also enhances the attractive forces between neighbouring particulate substrates 76. Above the percolation threshold, there is formed a particulate network exhibiting long-range connectivity. Containment of the particulate substrate 76 proximate to the cathode 83 aligns the particulates relative to the cathode 83 and thus the said long-range particulate network serves as an extension to the cathode 83. This directs the migration of metal ions $M^+$ from the anode 81 to the negatively charged particulate substrate 76. This allows coating of the particulate substrate 76 to occur substantially at the liquid interface 87 resulting in the desired metal coated substrate 77. To ensure the particulate substrate 76 remains dispersed an agitation device 75 may be introduced into the continuous electrodeposition system 71. The agitation device used may be the introduction of a non-ionic surfactant 80 into the organic liquid phase 86. The particulate substrate 76 is pumped by a pump system 85 from the reservoir of dispersion 73 into the continuous electrodeposition system 71. As the substrate is pumped past a large volume of electrolyte 84 a mixture of particulate substrate 76, organic solvent, non-ionic surfactant 80 and metal coated substrate 77 is pumped out of the electrodeposition bath 82 and into a magnetic collector 72. Any magnetic metal coated substrate is extracted by the magnetic collector 72 and any uncoated substrate 76 is re-introduced through the reservoir of dispersion 73 and pumped back into the electrodeposition bath 82.

What is claimed is:

1. A method of electrodepositing a metal on an electrically conductive particulate substrate comprising the steps of:

providing a cathode that is distinct from the particulate substrate;

providing an anode formed from the metal to be electrodeposited;

providing a separator between the anode and the cathode, the separator being a semipermeable membrane that is porous to an electrolyte and to the metal ions, but not to the particulate substrate, the separator being configured to maintain the particulate substrate within a substrate volume proximate to the cathode;

providing the particulate substrate within the substrate volume at a concentration that is in a range of from 0.0001 vol % to 5 vol %, where vol % refers to a percentage of the substrate volume that is occupied by the particulate substrate;

locating the substrate, cathode and anode within an electrodeposition bath comprising the electrolyte; and applying a voltage between said anode and cathode, thereby causing metal ions to flow from the anode to the cathode.

2. The method according to claim 1, wherein the substrate has an average longest dimension of less than 10 mm.

3. The method according to claim 2, wherein the substrate is a nano-scaled carbon particulate.

4. The method according to claim 1, further comprising applying agitation using at least one agitation device, thereby preventing particle agglomeration.

5. The method according to claim 1, wherein the electrodeposited metal is a ferromagnetic metal.

6. The method according to claim 5, further comprising using a magnetic field to capture magnetic metal coated particulate substrate from the electrodeposition bath.

7. The method according to claim 1, wherein the particulate substrate comprises non-electrically conductive particles coated with electrically conductive coatings.

8. The method according to claim 1, wherein the method is implemented as a batch process.

9. The method according to claim 6, wherein the captured substrate is an electrically conductive particulate comprising an electrodeposited metal thereon.

10. The method according to claim 1, wherein the method is implemented as a continuous process.

* * * * *